United States Patent [19]

Enody et al.

[11] 3,945,072

[45] Mar. 23, 1976

[54] APPARATUS FOR THE CONTROL OF DIE HEADS OF PRESSES WITH MOVABLE DIES

[75] Inventors: Emil Enödy; Sándor Kovács; István Gelányi; Béla Károly; Béla Kacsmarek, all of Budapest, Hungary

[73] Assignee: Ateliers J. Hanrez S.A., Monceau-sur-Sambre, Belgium

[22] Filed: June 30, 1975

[21] Appl. No.: 591,459

[30] Foreign Application Priority Data

July 4, 1974 Hungary ..... 9445

[52] U.S. Cl. ..... 10/13; 10/15; 72/447

[51] Int. Cl.[2] ..... B21J 13/02

[58] Field of Search ..... 72/447, 448, 452; 10/11 A, 10/11 R, 12 R, 13, 15, 158

[56] References Cited

UNITED STATES PATENTS

| | | | |
|---|---|---|---|
| 2,303,662 | 12/1942 | Schwartz | 10/13 |
| 2,664,579 | 1/1954 | Akey | 10/13 |
| 3,720,968 | 3/1973 | Garlaschi | 10/11 A |
| 3,755,839 | 9/1973 | Enödy | 10/13 |

FOREIGN PATENTS OR APPLICATIONS

| | | | |
|---|---|---|---|
| 560,403 | 4/1957 | Italy | 10/13 |

*Primary Examiner*—C. W. Lanham
*Assistant Examiner*—Gene P. Crosby
*Attorney, Agent, or Firm*—Poms, Smith, Lande & Glenny

[57] ABSTRACT

Apparatus is disclosed for controlling die heads of screw-making presses having movable dies comprising a die head rotatably mounted on a shaft and having two dies, and a pivotally mounted controlling fork with a cam surface engaging the die head by rollers. The sections of the cam surface nearest to the pivotal axis of the fork are circular arcs centred on the pivotal axis while those sections of the fork which are farther from the pivotal axis and which engage the rollers are shaped as curves the distance of which increased from the pivotal axis in the direction of the working movement of the rollers. The circular arcs and the farther sections are connected by transitional sections.

3 Claims, 3 Drawing Figures

APPARATUS FOR THE CONTROL OF DIE HEADS OF PRESSES WITH MOVABLE DIES

Figure 1:
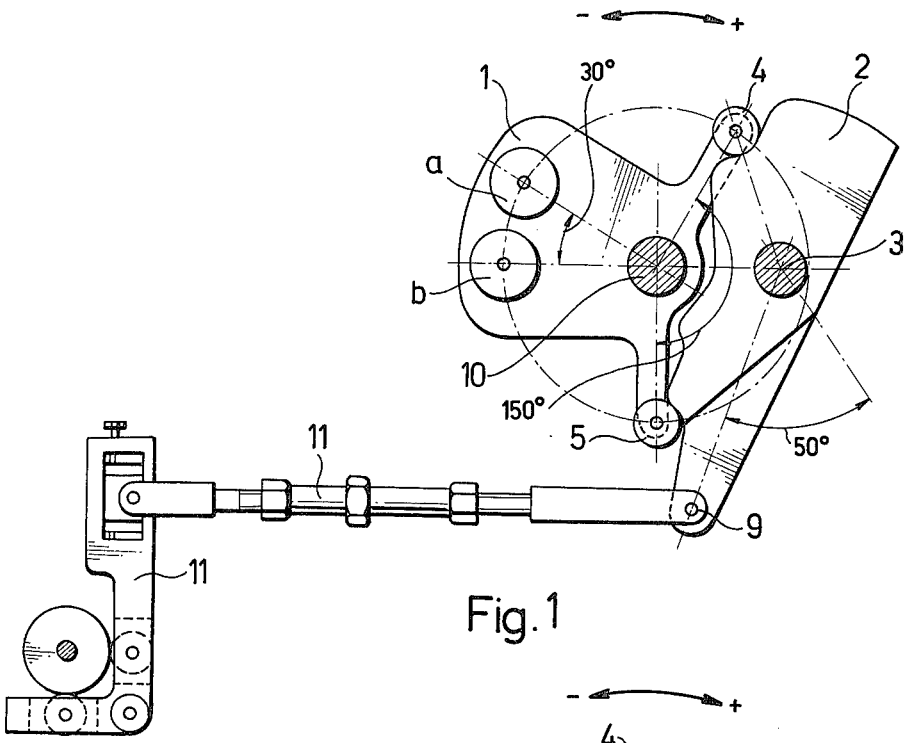

This invention concerns apparatus for the control of die heads of presses with movable dies, especially automatic rapid-operation presses for the production of screws, wherein there is a control mechanism that carries out both the automatic fixing or securing and the release of the dies.

In the interest of increasing the productivity of screw manufacture, machines with moving dies have become known, the aim of which is to produce in a plurality of sequential operations one finished product per stroke. Such known machines include rotary presses which perform a complete revolution, and presses with oscillating heads reciprocating over 180°, or with oscillating heads that perform partial rotation also.

It is a common characteristic of all known presses that there is a separate control device for angularly displacing the die heads, while to ensure a fixed working position for the die, as required for the actual pressing, separately controlled position securing devices are necessary.

A common disadvantage of the foregoing is that, within one and the same period (cycle), respectively after the angular displacement and before the return displacement of the dies heads, i.e. before and after the forming of the screw, there has to be provided in the cycle an operational period of (X/360°) for the control which can only be achieved by shortening the operational periods of the various other controls and thus a reduction in productivity results.

A further disadvantage of known machines are that they all require separate controlled mechanisms, discs, arms etc. which significantly complicate their constructions, and that the securing devices in use exert certain force effects on the displaceable die head which are deleterious from the points of view of wear and service life.

Also, an interlocking step forms part of the operational cycle and this disadvantageously influences the performance, reliability and service life of currently known machines.

The present invention aims to eliminate, or at least reduce, the above disadvantages and to provide a device for controlling and rotating the die head and the dies which device performs the displacement of the dies and die head so that at the end of its movement in either angular direction the displaced die head automatically takes up a fixed position, while the release operation constitutes at the same time the start of the return movement of the die head.

To achieve this aim, it has been necessary to make the discovery that to effect an angular displacement of a given angle all hitherto used rigid devices (pivoted devices, pinion segments etc.) i.e. positive couplings, can be obviated by providing mechanical connections such that the driving, i.e. the device that effect the required angular displacement of the die head, is displaced by a greater amount while the mechanism to be displaced can turn only by the desired amount.

The invention has the characteristic that it has a guiding or controlling fork a portion of which is in contact with the rollers of the die head and the portions of the fork which are nearer to the pivoting point thereof are in the form of circular arcs of the same radius the centre of which is the pivotal point of the guiding or controlling fork. Those sections of the guidefork which are beyond the just described sections are in the form of curves the distance of which from the pivotal point increases lightly in the direction of the working path of the rollers. The sections of circular arc shape and the path section deviating from the circular arc shape have between them transitional connecting sections.

Thus the essence of our invention is a controlling mechanism without any positive coupling wherein, in one part of the two continuous movement phases of the controlling mechanism, the controlled mechanism or unit is angularly displaced about its own axis, while in the second part of the movement phases a geometrical position results in which the controlled unit in rolling contact with the controlling mechanism cannot rotate any further and at the same time further angular displacement is positively prevented, in both angular senses.

Figure 2:
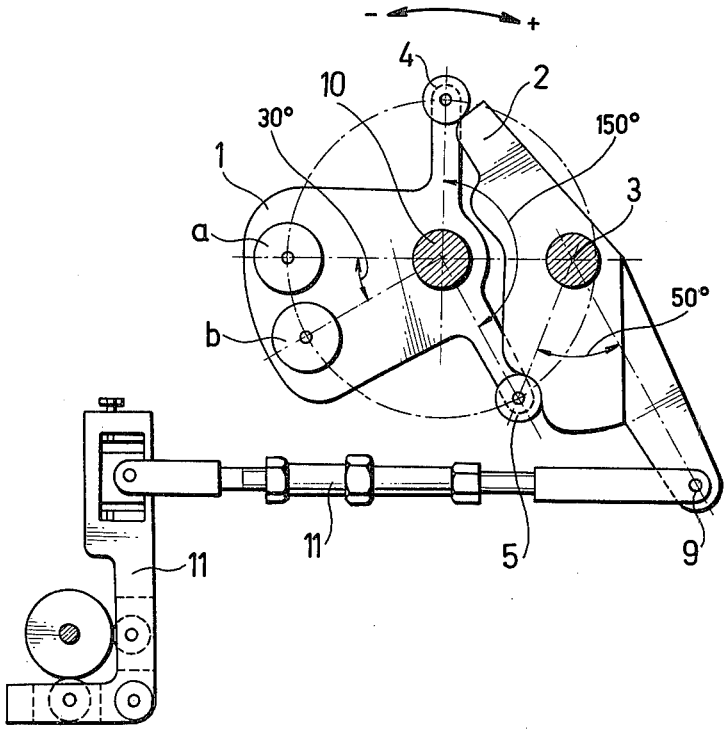
Figure 3:
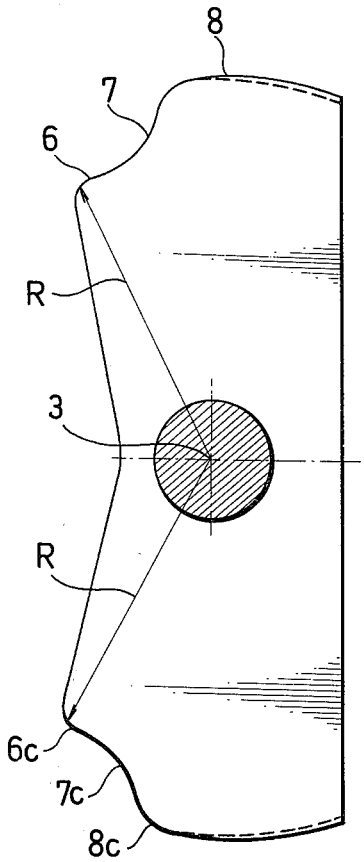

A preferred embodiment of the invention will now be described, by way of example, with reference to the accompanying drawings, wherein:

FIG. 1 is a schematic diagram of the apparatus according to the invention, in its upper position, FIG. 2 is a schematic diagram of the apparatus of FIG. 1 in its lower position, and FIG. 3 illustrates the profile (contour) of the controlling unit formed as a so-called fork on an enlarged scale.

Referring to the drawing, a screw-making die head 1 has two dies *a*, *b* in it. The dies can be angularly displaced along a circular arc of 30° (or more) per stroke about an axis or shaft 10 in either of two opposite angular sense, and can be fixed in position. On the die head 1 two radial arms are integrally formed and these arms carry respective rollers 4, 5 the rotational axes of which are parallel with the axis 10, and are disposed on the same circle (shown in chain lines) as the centre points of the dies *a*, *b*, this circle being centred at 10. In the illustrated example, the radial lines connecting the axis 10 of the die head 1 and the axes of rotation of the rollers 4 and 5 include an angle of 150°.

In the vicinity of the axis 10 and independently of the die head 1 a pivotal point 3 is formed in the otherwise non-illustrated machine body. In the pivotal point 3 a controlling fork 2 is disposed which can be angularly displaced independently of the die head and which has two sections or cams for effecting angular displacement and locking. The controlling fork 2 is connected by way of a pivot 9 and linkage 11 to a cammed disc pair which in itself is known and which is disposed on an auxiliary shaft; the pair of cammed discs serves to oscillate the controlling fork 2 about its pivotal point 3 to a predetermined extent, e.g. by 50°.

The shaft of the die head and the pivotal axis of the controlling fork are located on the machine body at the same height.

During the reciprocating angular displacement of the controlling fork 2 the rollers 4 and 5 disposed on the die head 1 are in rolling contact with the control surfaces of the fork 2 and roll in alternating angular directions along the two rising or descending paths or cams provided by the guiding fork 2 to cause, in the illustrated example, the die head 1 to be angularly displaced by 30°.

The controlling fork 2 has substantially similarly shaped upper and lower parts. Relative to the pivotal point 3, the parts have corresponding cam portions or sections 6, 6*c*; 7, 7*c* and 8, 8*c*. Of these the sections 6,

6*c* are shaped as circular arcs of radius R and are nearest to the pivotal point 3; the sections 8, 8*c* farthest from the pivotal point or axis 3 deviate from a circular arc and relative to the pivotal point 3 have a lightly rising or descending characteristic. The transitional section 7 and 7*c* merely connect the previously mentioned sections.

In FIG. 1, as shown by the double-headed arrow, in the upper position of the die *a* the roller 4 closes the cam section 6 with a positive (+) angular sense while the roller 5 closes with the section 8*c* with a negative (−) direction of rotation.

In FIG. 2, in the lower position of the die, the roller 4 closes with the cam section 8 with a positive sense of rotation while the roller 5 closes with the section 6*c* with a negative sense or rotation.

The cam sections 6 and 6*c*, formed as being the nearest to the pivotal point 3, each constitute a geometrical location or position wherein the rollers 4, 5 mounted on the die head 1 cannot be rotated beyond that position even if the controlling fork 2 rotates further. Thus the sections 6, 6*c* ensure the locking of the die head 1 in one direction of rotation about the axis 10. At the same time the sections 8, 8*c* farthest from the pivotal point 3 carry out the braking and locking in the opposite direction of the guided moving mass.

In whichever direction the controlling unit starts its return movement the locking is automatically released since this is effected not by force effects but by the geometrical positions of the cam sections.

We claim:

1. In presses with movable dies, especially screwmaking machines consisting, as principal constructional elements, of a die head mounted on a shaft, two dies in the die head, and a pair of rollers on the die head, the use of controlling apparatus comprising a pivot shaft, a controlling fork mounted for pivotal movement on said shaft, a portion of said fork being adapted for rolling contact with the rollers on the die head, the sections of said portion nearest to the pivot shaft being circular arcs of the same radius, the centre point of each arc lying on the pivotal axis of the controlling fork, while those sections of the said fork which are farther from the pivot shaft than the said circular sections, and which are in use in contact with the rollers, are in the form of curves the distance of which from the said pivotal axis lightly increases in the direction of the working movement of the rollers, and between the circular arc sections and the sections deviating from a circular arc shape there are connecting transitional sections.

2. Apparatus according to claim 1 including a machine body, the shaft of the die head and the pivotal shaft of the controlling fork being located on the machine body at the same height.

3. Apparatus according to claim 1 in which the angle included between the dies and the axis of the die head is at least 30°.

* * * * *